US008726517B2

(12) United States Patent
Lau

(10) Patent No.: US 8,726,517 B2
(45) Date of Patent: May 20, 2014

(54) TRIMMER MECHANISM, HAIR TRIMMER, AND HAIR TRIMMER ATTACHMENT

(75) Inventor: Tung Yan Lau, New Territories (HK)

(73) Assignee: Specialife Industries Limited, Hong Kong (HK)

( * ) Notice: Subject to any disclaimer, the term of this patent is extended or adjusted under 35 U.S.C. 154(b) by 880 days.

(21) Appl. No.: 12/685,086

(22) Filed: Jan. 11, 2010

(65) Prior Publication Data

US 2011/0167639 A1 Jul. 14, 2011

(51) Int. Cl.
*B26B 19/00* (2006.01)
*B26B 19/02* (2006.01)

(52) U.S. Cl.
USPC ..... 30/34.1; 30/43.91; 30/43.92

(58) Field of Classification Search
USPC ..... 30/34.1, 43.7–46, 208–210, 215, 216
See application file for complete search history.

(56) References Cited

U.S. PATENT DOCUMENTS

| | | | | | |
|---|---|---|---|---|---|
| 458,940 | A * | 9/1891 | Bonham | 30/199 |
| 1,380,272 | A * | 5/1921 | Tomasulo | 30/34.1 |
| 1,519,601 | A * | 12/1924 | Tomasulo | 30/216 |
| 2,300,143 | A * | 10/1942 | Berg | 30/34.1 |
| 2,350,805 | A * | 6/1944 | Olving | 30/34.1 |
| 2,484,610 | A * | 10/1949 | Cromonic | 30/210 |
| 2,948,063 | A * | 8/1960 | Jepson | 30/34.1 |
| 3,453,728 | A * | 7/1969 | Loner | 30/34.1 |
| 3,774,300 | A * | 11/1973 | Konig | 30/34.1 |
| 4,174,568 | A * | 11/1979 | Mixner | 30/34.1 |
| 4,262,415 | A * | 4/1981 | Braun | 30/34.1 |
| 5,325,590 | A * | 7/1994 | Andis et al. | 30/34.1 |
| 5,507,095 | A * | 4/1996 | Wetzel et al. | 30/34.1 |
| 6,314,648 | B1 * | 11/2001 | Hillebrandt | 30/34.1 |
| 6,317,982 | B1 * | 11/2001 | Andrew | 30/34.1 |
| 6,502,312 | B2 * | 1/2003 | Beutel et al. | 30/34.1 |
| 6,604,287 | B2 * | 8/2003 | Melton et al. | 30/34.1 |
| 6,684,507 | B2 * | 2/2004 | Lau et al. | 30/34.1 |
| 7,503,117 | B2 * | 3/2009 | Wetzel et al. | 30/34.1 |
| 7,900,359 | B2 * | 3/2011 | Royle | 30/34.1 |
| 7,937,837 | B2 * | 5/2011 | Psimadas et al. | 30/34.1 |
| 8,141,253 | B2 * | 3/2012 | Royle | 30/34.1 |
| 8,381,405 | B2 * | 2/2013 | Shigeta et al. | 30/34.1 |
| 2003/0106219 | A1 * | 6/2003 | Lau | 30/34.1 |
| 2006/0168816 | A1 * | 8/2006 | Wetzell et al. | 30/34.1 |
| 2008/0168662 | A1 * | 7/2008 | Mikula et al. | 30/233 |
| 2008/0263869 | A1 * | 10/2008 | Floessholzer | 30/34.1 |
| 2010/0139097 | A1 * | 6/2010 | Perez-Lopez et al. | 30/34.1 |
| 2010/0299927 | A1 * | 12/2010 | Fischer et al. | 30/34.1 |
| 2011/0126412 | A1 * | 6/2011 | Perez-Lopez et al. | 30/34.1 |
| 2011/0131812 | A1 * | 6/2011 | Erndt et al. | 30/34.1 |
| 2012/0137524 | A1 * | 6/2012 | Mikula et al. | 30/34.1 |
| 2012/0151774 | A1 * | 6/2012 | Shimizu et al. | 30/43.92 |

* cited by examiner

*Primary Examiner* — Jason Daniel Prone
(74) *Attorney, Agent, or Firm* — Ostrolenk Faber LLP

(57) ABSTRACT

A trimmer mechanism suitable for use in a hair trimmer and hair trimmer attachment is described. The trimmer mechanism allows for a linearly reciprocating motion to be used to obtain a close trim or shave. The trimmer mechanism includes two sets of blades that are moveable relative to each other to define a pair of cutting zones. One set of blades provides a coarse trim, while the following set of blades provides a finer trim. Also provides is a blade arrangement and a method of manufacture of a blade arrangement.

34 Claims, 16 Drawing Sheets

TRIMMER MECHANISM, HAIR TRIMMER, AND HAIR TRIMMER ATTACHMENT

FIELD OF THE INVENTION

The present invention relates to a trimmer, trimmer attachment and trimmer mechanism and method therefor. More particularly but not exclusively it relates to a hair trimmer and hair trimmer attachment and trimmer mechanism for use therein.

BACKGROUND TO THE INVENTION

Electrical shavers or trimmers for trimming facial and body hair are well known. Two types of electric shavers are currently available. These are the foil shaver-type and the rotary shaver-type.

The foil shaver type includes a thin metal mesh covering a cutter blade as it moves over the surface of the mesh. Hair extends through the apertures of the metal mesh, and is caught in a scissoring action between the metal mesh and the cutter. Foil shavers are available in single, dual, and triple foil heads.

The rotary shaver includes a blade rotating on axis which is covered by a circular head extending perpendicularly to the axis of rotation. The circular heard also includes apertures in it through which hair is received to be cut off in a shearing action between the blade and the circular head.

However, both of these types of shavers require the user to typically traverse the same area a few times before all of the hair is trimmed and the shaving process is completed. These processes rely on the ends of the hair to be inserted through the respective apertures of the circular head and the foil mesh. A persons hair may not all be uniformly oriented, especially when it is long. For this reason, these shavers are unsuited to trimming longer hair. The holes or slits in the mesh could be enlarged, but this would increase the risk of a user's skin touching the moving blade and causing injury.

Other shavers include the linear reciprocating shavers, one example of which is produced by Wahl™. This includes a pair of flat planar blades abutting each other, and moving in a linearly reciprocating fashion relative to each other. The blades each define a row of teeth along one edge. The relative movement between the teeth defines a cutting zone where hair is caught in a scissoring action between the respective sets of teeth.

However, these shavers also inherently unsuited to provide as close a shave as the foil shaver or rotary shavers are. This is because such shavers are typically robustly designed for trimming long hair. The closeness of the shave afforded by these types of shaver is limited by the thickness of their blades.

Another problem with the linear reciprocating motion-type shavers is that their blades cannot be too thin, as this may result in them being sharp enough to cut a user.

In this specification, where reference has been made to external sources of information, including patent specifications and other documents, this is generally for the purpose of providing a context for discussing the features of the present invention. Unless stated otherwise, reference to such sources of information is not to be construed, in any jurisdiction, as an admission that such sources of information are prior art or form part of the common general knowledge in the art.

In this specification, where reference has been made to a series of steps in a process or method, this should not be construed as establishing a chronological order for the steps.

OBJECT OF THE INVENTION

It is an object of the present invention to provide a trimmer and trimmer mechanism which overcomes or at least ameliorates some of the abovementioned disadvantages or which at least provides the public with a useful choice.

It is an alternate objective of the present invention to provide a trimmer that is capable of providing a close shave to a user without the user having to traverse the same area many times.

It is an alternate objective of the present invention to provide a trimmer that is capable of providing a close shave while reducing the danger of being cut by a user.

SUMMARY OF THE INVENTION

In a first aspect the present invention broadly consists in a trimmer mechanism comprising a coarse blade arrangement comprising a plurality of abutting longitudinal blades movable relative to each other in a linearly reciprocating fashion, each of the blades including a plurality of teeth disposed along a cutting edge, the cutting edges of the blades being at least partially in longitudinal alignment with each other so that relative movement between the teeth define a coarse cutting zone suitable for trimming hair, and a fine blade arrangement comprising a plurality of abutting longitudinal blades movable relative to each other in a linearly reciprocating fashion, each of the blades including a plurality of teeth disposed along a cutting edge, the cutting edges of the blades being at least partially in longitudinal alignment with each other so that relative movement between the teeth define a fine cutting zone suitable for trimming hair, wherein the fine blade arrangement is configured and adapted to provide a closer trim than the coarse blade arrangement.

Preferably, the one or more selected from the characteristic of length, width, size, thickness and pitch of the teeth of at least one blade in the fine blade arrangement are smaller than that of the smallest blade in the coarse blade arrangement.

Preferably, one or more selected from of length, width, size, thickness and pitch of the teeth of the plurality of blades of the fine blade arrangement, are smaller than the corresponding characteristic of the plurality of blades of the coarse blade arrangement.

Preferably, the fine blade arrangement comprises at least one stationary blade and at least one movable blade, movable relative to each other.

Preferably, the coarse blade arrangement comprises at least one stationary blade and at least one movable blade, movable relative to each other.

Preferably, the trimmer mechanism includes a housing on which the coarse blade arrangement and the fine blade arrangement are mounted.

Preferably, the fine blade arrangement includes a blade arrangement as described below.

Preferably, the fine blade arrangement includes a plurality of blades movable relative to each other, wherein one blade extends further from the housing than the other, and includes a lip along at least part of a distal edge that extends out of the plane of the blade.

Preferably, the lip extends out of the plane of the blade to form a convex surface for operational location against a surface to be trimmed.

Preferably, the blades each comprise a pair of opposed major faces and at least one cutting edge.

Preferably, the plurality of blades abut each other at a major face.

Preferably, the lip extends towards and at least partially surrounds the teeth of another adjacent blade.

Preferably, the lip extends away from the teeth of another adjacent blade.

Preferably, the fine cutting zone is disposed in parallel alignment with the coarse cutting zone.

Preferably, the fine blade arrangement is disposable in an alignment relative to the coarse blade arrangement, so that operationally when the coarse cutting zone is drawn over a surface, the fine cutting zone is likely to make contact with the same surface.

Preferably, the fine blade arrangement is movable between a close position in which the fine cutting zone is disposed in an alignment so that operationally when the coarse cutting zone is drawn over a surface, the fine cutting zone is likely to make contact with the same surface; and a distanced position in which the fine cutting zone is disposed in an alignment so that operationally when the coarse cutting zone is drawn over a surface, the fine cutting zone is less likely to make contact with the same surface.

Preferably the fine blade arrangement includes a movable housing that moves with it between its close position and its distance position.

Preferably, the fine cutting zone is biased towards its close position.

Preferably, the fine cutting zone is biased towards its close position by a biasing means.

Preferably, the biasing arrangement is one or more selected from a spring; and resilient member.

Preferably, the fine cutting zone remains in parallel alignment with the coarse cutting zone while the fine blade arrangement is movable between its close position and distanced position Preferably the fine cutting zone is substantially planar in configuration.

Preferably the coarse cutting zone is substantially planar in configuration.

Preferably, the fine cutting zone remains in parallel planar alignment with the coarse cutting zone while the fine blade arrangement is movable between its close position and distanced position Preferably, the fine cutting zone moves closer to longitudinal alignment with the coarse cutting zone as the fine blade arrangement moves from its distanced position to its close position.

Preferably, the trimmer mechanism further comprises a locking mechanism adapted and configured for locking the fine blade arrangement in its distanced position.

Preferably, the locking mechanism also prevents relative movement of the blades of the fine blade arrangement when locking the fine blade arrangement in its distanced position.

Preferably, the locking mechanism also locks relative movement of the blades of the fine blade arrangement when locking the fine blade arrangement in its distanced position.

Alternately the trimmer mechanism further comprises a movement locking mechanism adapted and configured for locking relative movement of the fine blade arrangement.

Preferably, the movement locking mechanism allows movement of the fine blade arrangement between its distanced position and close position while locking relative movement between the blades.

Preferably, the trimmer mechanism further comprises a mechanical linkage for driving movement of the fine blade arrangement and the coarse blade arrangement.

Preferably, the mechanical linkage translates rotational motion from an electrical motor into reciprocating linear movement to drive relative movement of the blades of the fine blade arrangement and the coarse blade arrangement.

Preferably, the mechanical linkage includes a sliding arrangement comprising a sliding member movable in a linear sliding fashion and coupled to one or more movable blades;

a receiving formation for receiving an off-centre rotating pin, said receiving formation being adapted to allow the pin to slide within the receiving formation in one dimension, but causes the pin to drive linear reciprocating movement of the sliding member when the pin moves in a second dimension.

Preferably, the receiving formation is one or more selected from an elongate recess or aperture.

Preferably, the mechanical linkage further includes a rotating arrangement comprising a rotating member rotatable about an axis, and a off-centre pin extending from the reciprocating member.

Preferably, the rotating member is coupled to an electrical motor for rotation.

Preferably, the trimmer mechanism includes a handle for convenient manual manipulation of the trimmer mechanism.

According to a further aspect, the invention may be said to broadly consist in a hair trimmer including a trimmer mechanism.

Preferably, the hair trimmer further comprises an electrical motor.

Preferably, the hair trimmer further comprises a power coupling for coupling the electrical motor to a power source.

Preferably, the power source is a battery.

Alternately, the power source is the electrical mains supply.

According to a further aspect, the invention may be said to broadly consist in a hair trimmer attachment including a trimmer mechanism.

Preferably, the hair trimmer attachment includes a coupling mechanism for convenient coupling and decoupling of the hair trimmer attachment to a driver.

Preferably, the coupling mechanism is one or more selected from a bayonet type coupling, a thread type coupling, a snap-fit type coupling, or any other coupling fit for purpose.

According to a further aspect, the invention may be said to broadly consist in a blade arrangement for a trimmer mechanism, said blade arrangement comprising a plurality of blades, each including at least one major face and a cutting edge defining a plurality of teeth;

said blades being mounted for linear reciprocating movement relative to each other, said blades being mounted in abutment with each other at at least part of each blades major face;

wherein one of the blades extends to a point further from the mounting than another blade in abutment with it, and includes a lip along at least part of a distal edge that extends out of the plane of the blade's major face.

According to a further aspect, the invention may be said to broadly consist in a blade arrangement for a trimmer mechanism, said blade arrangement comprising a plurality of blades, each including at least one major face and a cutting edge defining a plurality of teeth;

said blades being mounted for linear reciprocating movement relative to each other, said blades being disposed in abutment with each other at at least part of their major faces with their cutting edges in alignment so that the relative movement between the cutting edges defines a cutting zone suitable for trimming hair;

wherein one of the blades includes a lip along at least part of its cutting edge that extends out of the plane of that blade's major face and distally of the cutting edge of the movable blade.

Preferably, the cutting edges of the blades are mountable in alignment so that the relative movement between the teeth on each of the adjacent cutting edges forms a cutting zone.

Preferably, the lip extends out of the plane of the blade to form a substantially convex surface for operational location against a surface to be trimmed, wherein the convex surface is configured and dimensioned to prevent injury to a user operationally.

Preferably, the lip extends out of the plane of the blade to form an angled surface for operational location against a surface to be trimmed, wherein the angled surface is configured and dimensioned to prevent injury to a user operationally.

Preferably, the blades each comprise a pair of opposed major faces major face and at least one cutting edge.

Preferably, the cutting edges of the blades each comprises a plurality of teeth.

Preferably, the lip extends at least partially around the teeth of another adjacent blade.

Preferably, the lip extends away from the teeth of another adjacent blade.

Preferably, the lip includes rounded edges to prevent injury to a user operationally.

Preferably, the lip starts extending out of plane of that blade's major face at a point further from the mounting than the most distal edge of another blade mounted in abutment with that blade.

Preferably, the blades are substantially rectangular shaped.

Preferably, the blade arrangement comprises a pair of blades.

Preferably, one blade is a stationary blade securable to the mounting in a stationary manner.

Preferably, one blade is a movable blade mountable to the mounting in a movable manner to move relative to a stationary blade.

Preferably, the stationary blade includes the lip.

Preferably, the stationary blade and movable blade are adapted and configured for being moved in a linear reciprocating manner relative to each other.

Preferably, the stationary blade and movable blade have complementary engagement formations adapted for movable engagement with each other.

Preferably, the complementary engagement formations define a track formation and a track follower formation.

Preferably, the complementary engagement formations are a channel and ridge formation.

Preferably, adjacent blades have similar teeth.

Preferably, the stationary blade is wider than the movable blade.

Preferably, the toothed edge on one major face of one or more selected from the stationary blade and the movable blade, is out of plane with the rest of the major face.

Preferably, the toothed edge on one major face of one or more selected from the stationary blade and the movable blade, is out of plane with the rest of the major face to form a first and second surface.

Preferably, the toothed edge on both major faces of one or more selected from the stationary blade and the movable blade is out of plane with the rest of the major face.

According to a further aspect, the invention may be said to broadly consist in a blade arrangement for a trimmer mechanism, said blade arrangement comprising a stationary blade including at least one major face and a cutting edge defining a plurality of teeth; and a movable blade including at least one major face and a cutting edge defining a plurality of teeth;

the stationary blade and movable blade being disposed in abutment with each other at at least part of their respective major faces, with their respective cutting edges being disposed adjacent each other;

said movable blade being movable relative to the stationary blade so that the relative movement between the teeth on each of the adjacent cutting edges forms a cutting zone;

wherein the stationary blade includes a lip along at least part of its cutting edge that extends out of the plane of the stationary blade's major face and distally of the cutting edge of the movable blade.

In another aspect, the invention maybe said to broadly consist in a hair trimmer mechanism including a blade arrangement as described.

In another aspect, the invention maybe said to broadly consist in a hair trimmer including a blade arrangement as described.

In another aspect, the invention maybe said to broadly consist in a removable hair trimmer attachment including a blade arrangement as described.

According to a further aspect, the invention may be said to broadly consist in a method of manufacture of a blade for a hair trimmer mechanism, said method comprising the steps (not necessarily being in chronological order) of providing a planar plate of sheet material having two opposed major faces;

deforming the plate to present a cutting edge defining a plurality of teeth along at least part of the cutting edge; and forming a lip on an edge of the cutting edge, wherein the lip extends out of the plane of the blade's major face.

Preferably, the lip extends out of the plane of the blade to form a substantially convex surface for operational location against a surface to be trimmed, wherein the convex surface is configured and dimensioned to prevent injury to a user operationally.

Preferably, the lip extends out of the plane of the blade to form an angled surface for operational location against a surface to be trimmed, wherein the convex surface is configured and dimensioned to prevent injury to a user operationally.

Preferably, the step of forming the lip is carried out by supporting a major surface of the plate except for the area where the lip is to be, and applying a compressive force against the plate, to bend the plate over to form a lip.

Alternately, the step of forming the lip is carried out by machining away the area of the remainder of the plate, except for the area of the major face where the lip is to be formed.

Preferably, the method includes the step of rounding the edges of the lip.

Preferably, the step of rounding the edges is carried out by one or more selected from buffing, polishing, sanding or grinding the edges of the lip.

Preferably, the step of deforming, deforms at least a portion of the cutting edge on at least one major face of the plate to reduce its thickness.

Preferably, the step of deforming is carried out by a press.

Preferably, the step of deforming results in a portion of the surface of that major face of the plate at the cutting edge of the plate is out of plane with another part of that major surface.

Preferably, the step of deforming deforms both major faces of the plate so that at least a portion of at least the cutting edge on both major faces results in a portion of the surface of that major face of the plate at that edge of the plate is out of plane with another part of that major surface.

Preferably, the step of deforming further comprises cutting out the shape of teeth at least partially along the cutting edge.

Preferably, the step of deforming is carried out over two steps comprising the steps of:

deforming the plate to reduce the thickness of the plate at the cutting edge by applying a force to the cutting edge at a major face while supporting the opposed major face, deforming both major faces of the plate by bending it so that at least a portion of the cutting edge on both major faces results in a portion of the surface of that major face of the plate at that edge of the plate being out of plane with another part of that major surface.

Preferably, the step(s) of deforming is carried on to deform the full length of the cutting edge.

Preferably, the step of deforming is carried out by applying force to at least a portion of the cutting edge.

Preferably, the step of deforming to thin the thickness of the plate is carried out by application of a force to one major face, and the step of grinding is applied to the opposed major face.

Preferably, the step of grinding is carried out over an entire face of the plate.

Preferably, the step(s) of deforming at least one or more of the opposed edges to thin the thickness of the plate is carried out by applying a force from the side of one major face while supporting the opposed major face.

Preferably, the step of deforming is carried out by application of a force to one major face to deform both major faces at at least one of the opposed edges.

Preferably, the step of grinding is applied at the opposite major face to that from which a force for deformation was applied.

Preferably, the step of deforming both major faces of the plates is carried out by applying a force to a part of one major face, while allowing the adjacent part of the opposed major face to remain unsupported.

Preferably, the step of deforming comprises applying a force to the full cutting edge of the plate.

Preferably, the plate is metallic.

Preferably, the method includes the step of machining the cutting edge of the plate to reduce the thickness of at least a portion of the cutting edge.

Preferably, the method includes the step of machining the deformed cutting edge of the plate to reduce the plate's thickness.

Preferably, the deformation of at least a portion of the cutting edge to thin the thickness of the plate is carried out by a hydraulic press.

Preferably, the deformation of at least a portion of the cutting edge to thin the thickness of the plate is carried out by transfer of kinetic energy.

Preferably, the deformation of at least a portion of the cutting edge to thin the thickness of the plate is carried out by transfer of kinetic energy in an impact from an impaction member.

Preferably, the step of deforming the plate includes the process of cutting teeth shapes out of the plate.

Preferably, the method includes the step of machining at least a portion of at least one opposed edge on a major face to thin the thickness of the plate.

Preferably, the step of machining results in a portion of the surface of that major face of the plate at the cutting edge being out of plane with another part of that major surface.

Preferably, the step of grinding is carried out on a major face of the plate on an opposed side of the plate to where the machining step was carried out.

Preferably, the step of deforming is carried out by application of a force to at least a portion of one major face while allowing the adjacent portion of the opposed major face to remain unsupported, thereby to deform both major faces.

Preferably, the step of deforming is carried out by application of a force to at least a portion of one major face while supporting the adjacent portion of the opposed major face, thereby to reduce the thickness of the plate at the said portion of the major face.

Other aspects of the invention may become apparent from the following description which is given by way of example only and with reference to the accompanying drawings.

As used herein the term "and/or" means "and" or "or", or both.

As used herein "(s)" following a noun means the plural and/or singular forms of the noun.

The term "comprising" as used in this specification [and claims] means "consisting at least in part of". When interpreting statements in this specification [and claims] which include that term, the features, prefaced by that term in each statement, all need to be present but other features can also be present. Related terms such as "comprise" and "comprised" are to be interpreted in the same manner.

The entire disclosures of all applications, patents and publications, cited above and below, if any, are hereby incorporated by reference.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

BRIEF DESCRIPTION OF THE DRAWINGS

The invention will now be described by way of example only and with reference to the drawings in which.

DETAILED DESCRIPTION OF THE PREFERRED EMBODIMENTS

With reference to the above drawings, in which similar features are generally indicated by similar numerals, a trimmer mechanism according to a first aspect of the invention is generally indicated by the numeral 1000, a hair trimmer by the numeral 2000 and a hair trimmer attachment by the numeral 3000.

In one embodiment now described, there is provided a trimmer mechanism 1000, comprising a coarse blade arrangement 1100 and a fine blade arrangement 1200. Each of the coarse blade arrangement 1100 and the fine blade arrangement 1200 comprise a pair of abutting longitudinal blades 1210, 1110 movable relative to each other in a linearly reciprocating fashion, with each of the blades 1210, 1110 including a plurality of teeth 1112 disposed along at least one cutting edge 1114, 1214. The cutting edges 1114 of the abutting blades of the coarse blade arrangement 1100 are at least partially in longitudinal alignment with each other so that relative movement between the adjacent teeth 1112 on the cutting edges 1114 of the coarse blade arrangement 1100 defines a substantially planar coarse cutting zone 1140 suitable for trimming hair.

Similarly, the cutting edges 1214 of the abutting blades 1210 of the fine blade arrangement 1200 are at least partially in longitudinal alignment with each other so that relative movement between the adjacent teeth 1212 on the cutting edges 1214 of the fine blade arrangement 1200 defines a substantially planar fine cutting zone 1240 suitable for trimming hair.

However the fine cutting zone 1240 differs from the coarse cutting zone in that the trim obtained at the coarse cutting zone is coarser (i.e. not as close to the skin).

This is because one or more selected from the characteristic of length, width, size, thickness and pitch of the teeth 1212 of the blades 1210 in the fine blade arrangement 1200 are smaller than the same characteristic of the blades 1210 in the coarse blade arrangement 1100.

The trimmer mechanism 1000 further comprises a housing 1300 on which the fine blade arrangement 1200 and the coarse blade arrangement 1100 is mounted. The housing 1300 defines a handle 1310 which a user (not shown) can use to draw the coarse cutting zone 1140 and fine cutting zone 1240 over a surface such as their skin to trim their hair.

In a preferred embodiment, each of the coarse blade arrangement 1100 and the fine blade arrangement 1200 comprise a movable blade 1130, 1230 and a stationary blade 1120, 1220. The respective stationary blades 1120, 1220 are secured to the housing 1300 while the movable blades 1130, 1230 are configured and adapted to be moved relative to the stationary blades 1120, 1220 in a linearly reciprocating manner.

Figure 5:
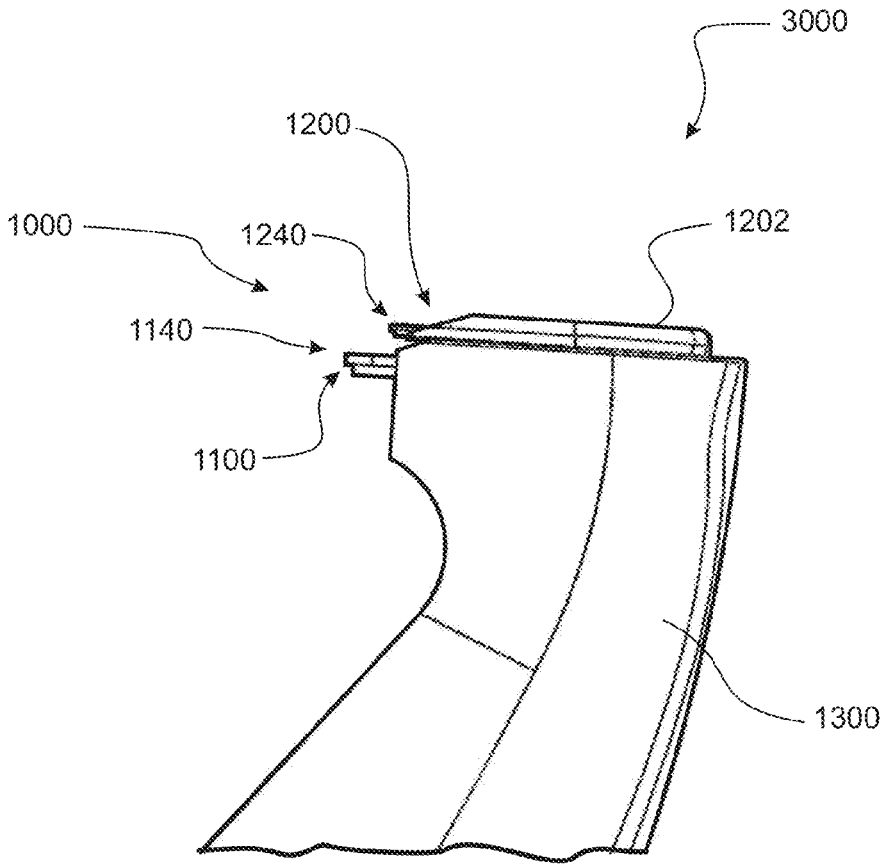
FIG. 5: shows a hair trimmer attachment.
Figure 6:
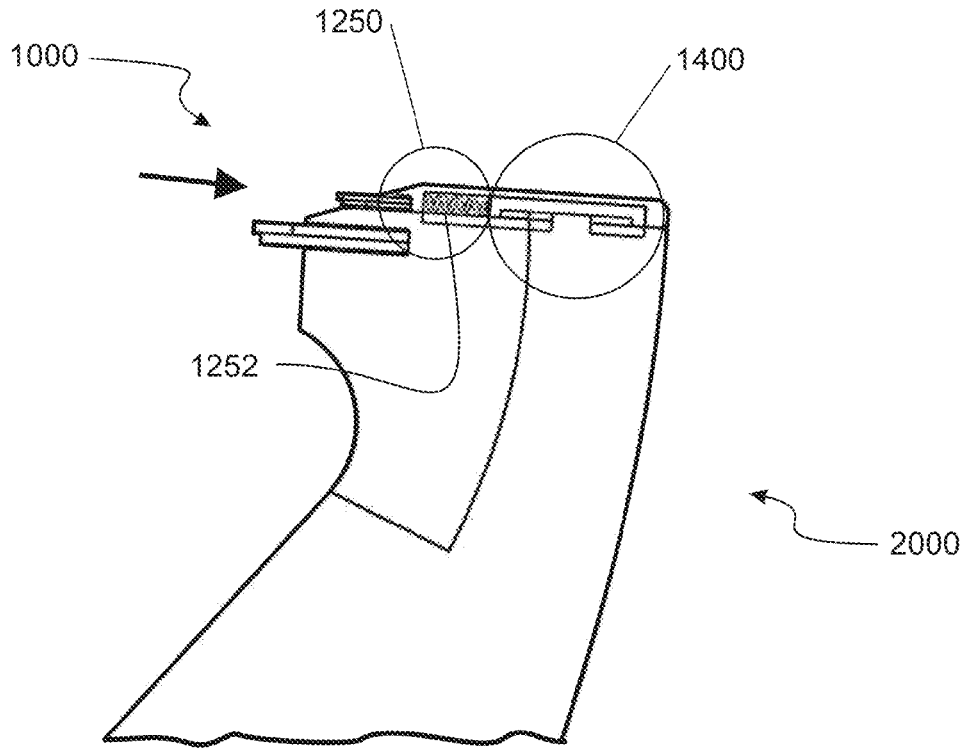
FIG. 6: shows a cutaway side view of the trimmer mechanism with the fine blade arrangement in its close position.
Figure 7:
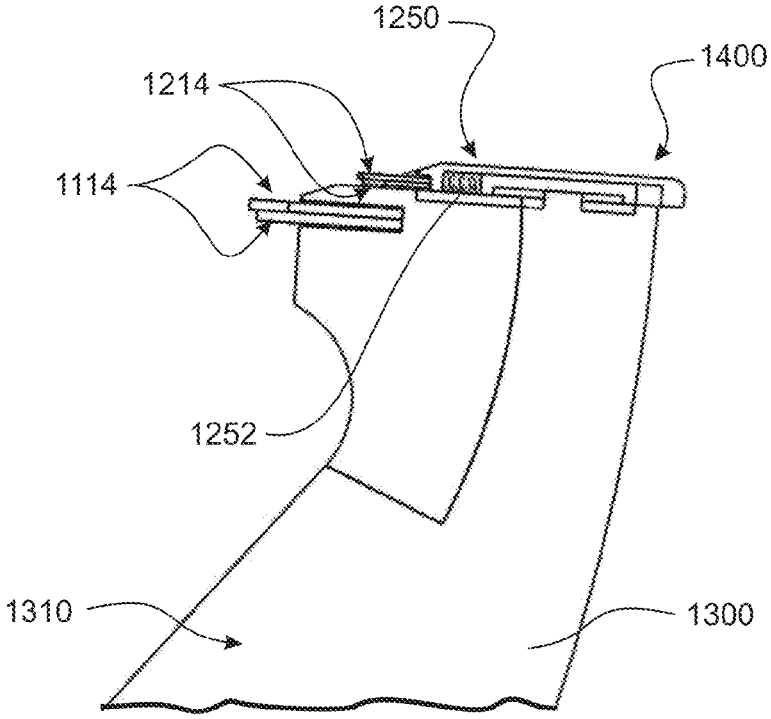
FIG. 7: shows a cutaway side view of the trimmer mechanism with the fine blade arrangement in its distanced position.

As shown in FIG. 5, in one embodiment, the fine cutting zone 1240 is disposed in parallel planar alignment with the coarse cutting zone 1140.

Figure 2:
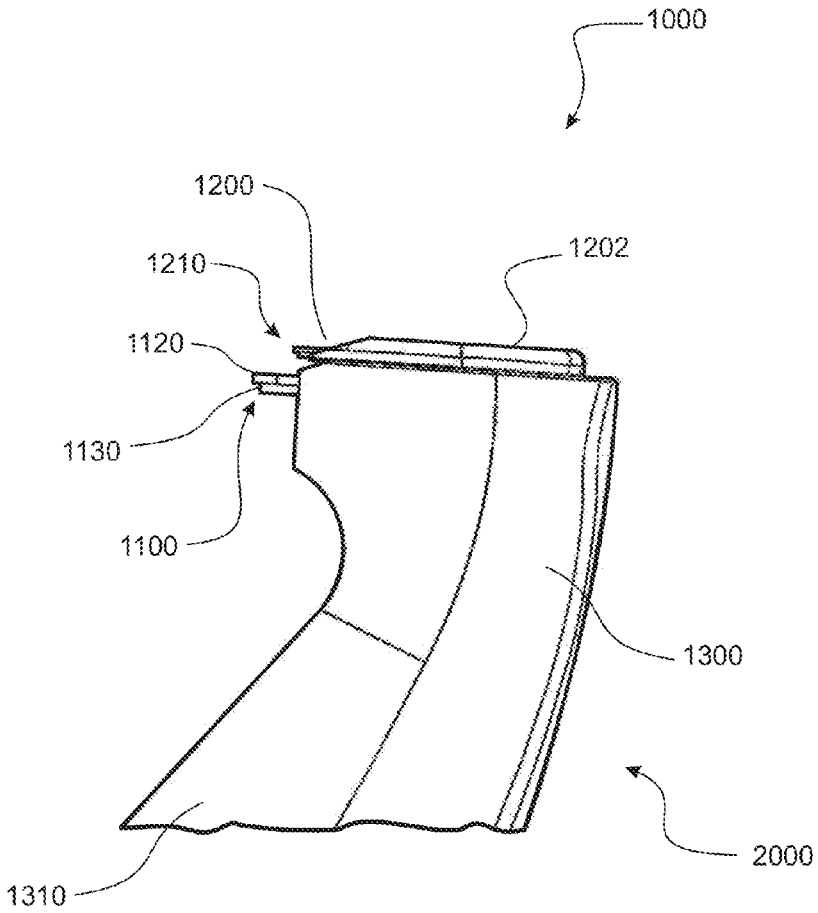
FIG. 2: shows a cutaway side view of the trimmer mechanism of FIG. 1 with the fine blade arrangement in close position.
Figure 3:
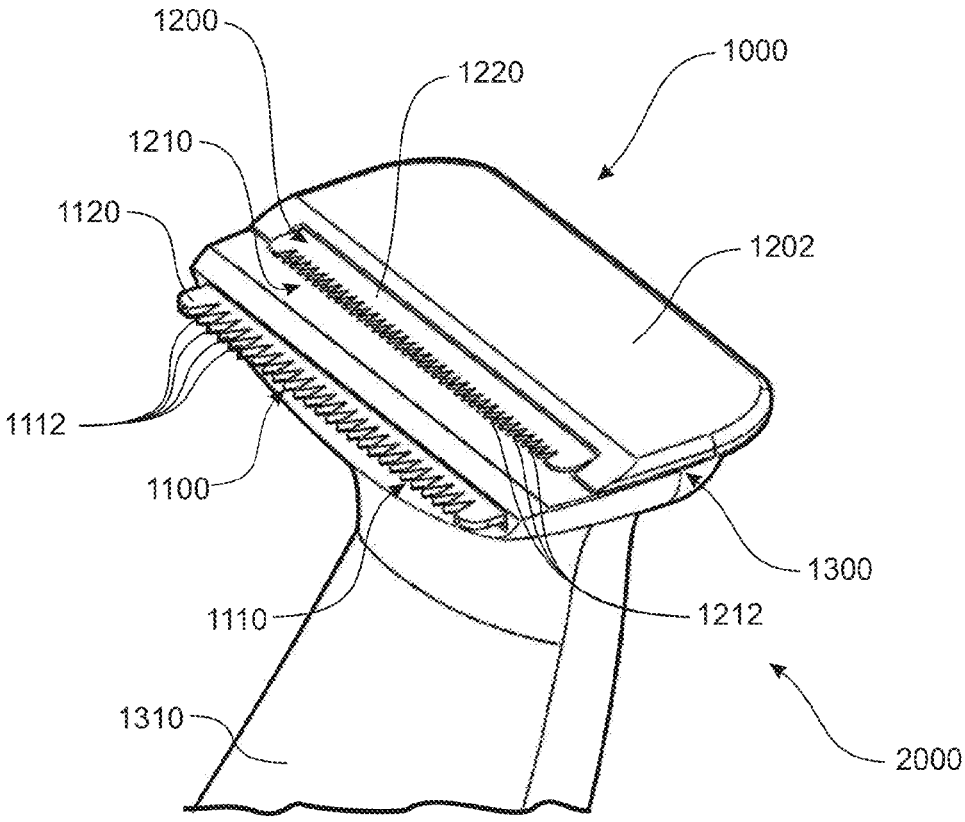
FIG. 3: shows a cutaway perspective view of a trimmer mechanism in a hair trimmer with the fine blade arrangement in distanced position.
Figure 4:
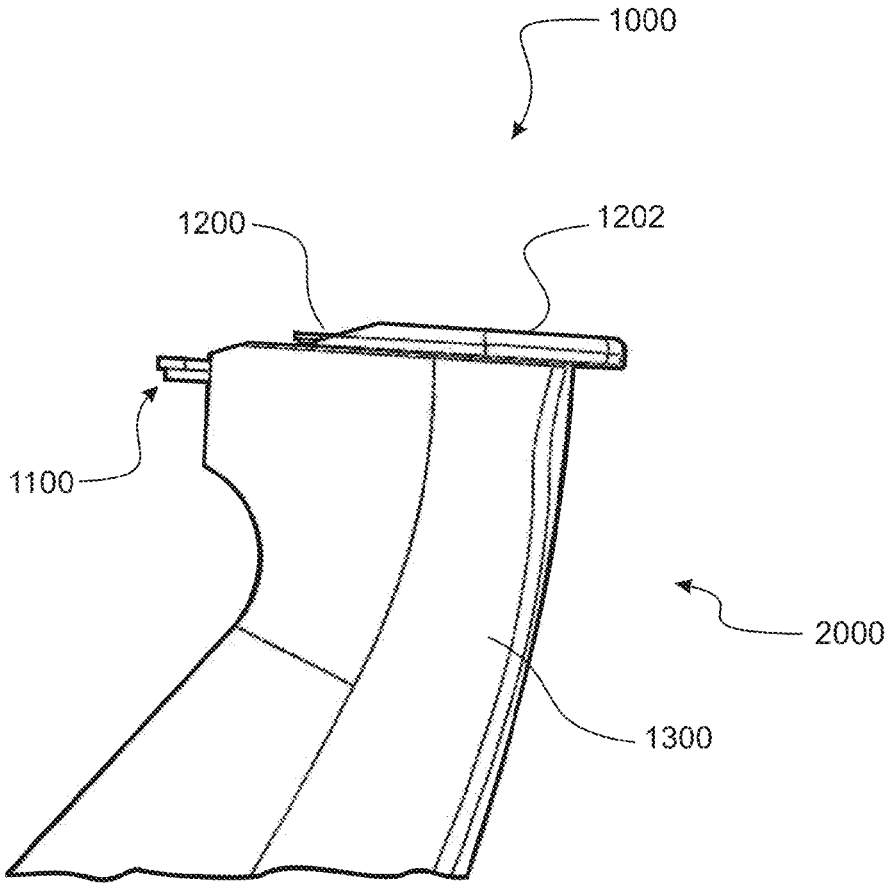
FIG. 4: shows a cutaway side view of the trimmer mechanism of FIG. 3 with the fine blade arrangement in distanced position.

In one preferred embodiment, the fine blade arrangement 1200 is movable between a close position shown in FIG. 2 and a distanced position shown in FIG. 4.

Figure 8:
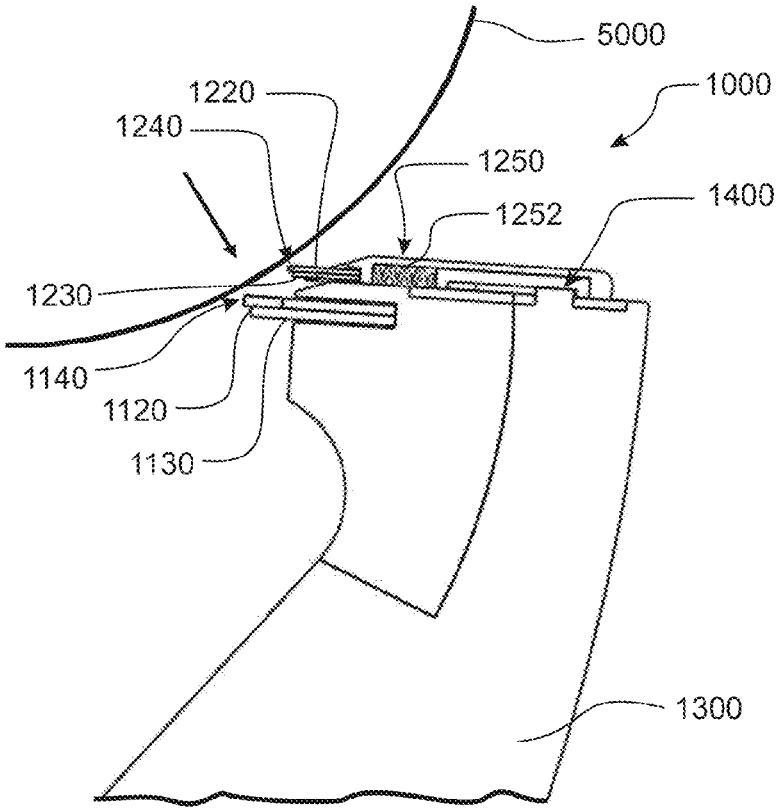
FIG. 8: shows a cutaway side view of the trimmer mechanism in operation against a surface to be trimmed of hair.

In the closed position, the fine cutting zone 1240 is disposed in an alignment (as shown in FIG. 8) so that operationally when the coarse cutting zone 1140 is drawn over a surface 5000, the fine cutting zone is more likely to make contact with the same surface 5000.

Figure 9:
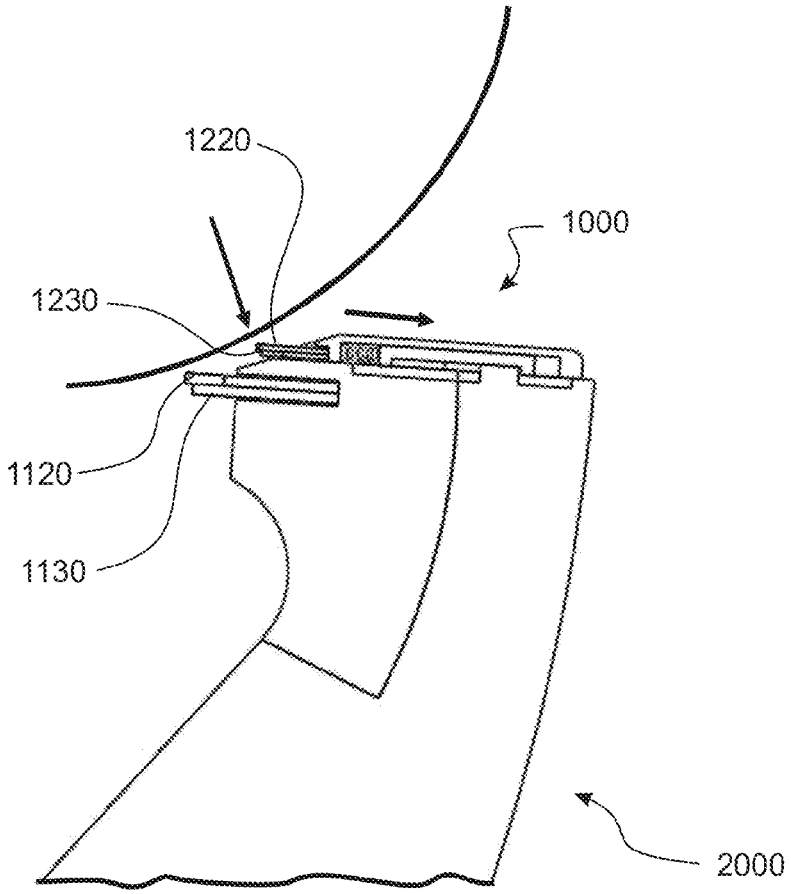
FIG. 9: shows a cutaway side view of the trimmer mechanism in operation against a surface to be trimmed of hair.

In the distanced position, the fine cutting zone 1240 is disposed in an alignment (as shown in FIG. 9) so that operationally when the coarse cutting zone 1140 is drawn over a surface 5000, the fine cutting zone is less likely to make contact with the same surface 5000.

It will be appreciated that in alternative embodiments, the fine blade arrangement 1200 need not be movable between a distanced and a close position, but could be fixed in position on the housing 1300.

In the embodiments shown, the fine blade arrangement is attached to and movable with a movable housing 1202 that moves with it between its close position and its distance position.

The fine cutting zone 1240 is biased towards its close position by a biasing arrangement 1250 in the form of a spring mechanism 1252 shown in FIG. 8. It is envisaged that many alternative biasing arrangements 1250, such as using resilient members (not shown) such as elastic bands (not shown) are also possible.

As the fine blade arrangement 1200 is movable between its close position and distanced position, the fine cutting zone 1240 remains in parallel alignment, as well as in parallel planar alignment with the coarse cutting zone 1140.

Figure 1:
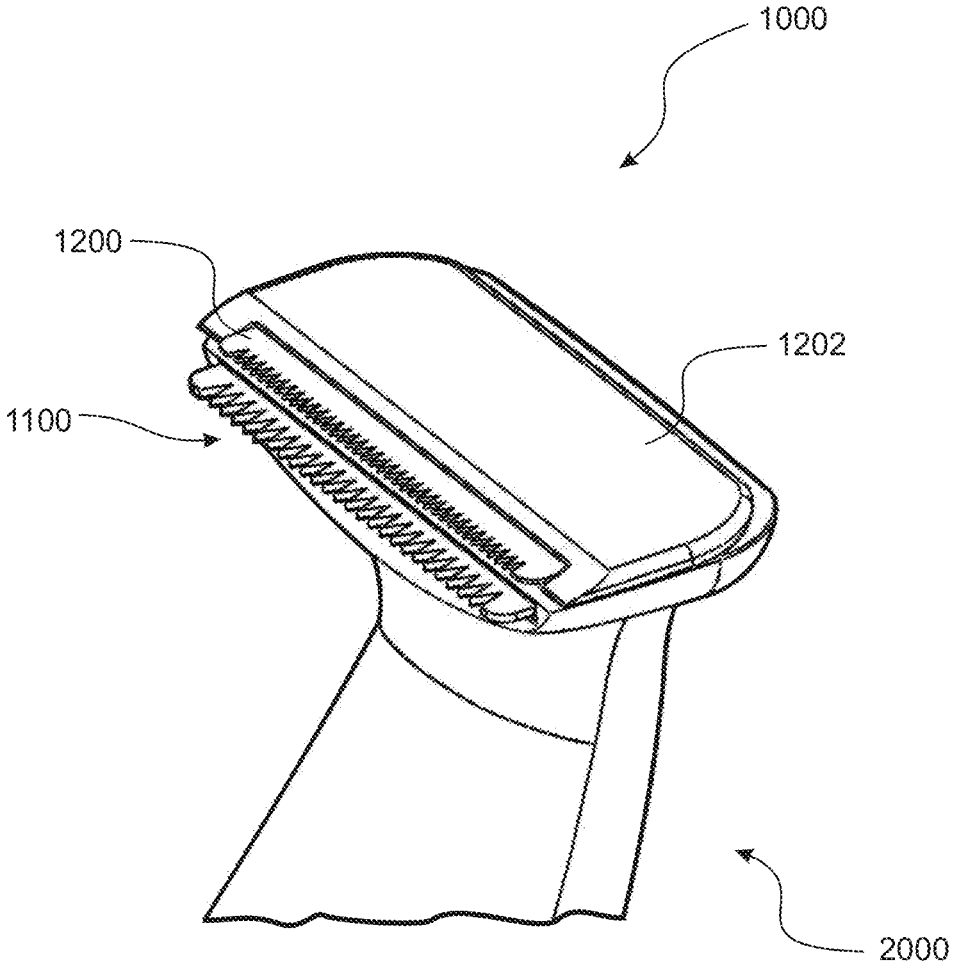
FIG. 1: shows a cutaway perspective view of a trimmer mechanism in a hair trimmer with the fine blade arrangement in close position.

As may be seen in FIG. 1, the fine cutting zone 1240 moves closer to longitudinal alignment with the coarse cutting zone 1140 as the fine blade arrangement 1200 moves from its distanced position to its close position.

When a user draws the trimmer mechanism 1000 over a skin surface 5000 by pulling the trimming mechanism 1000 by its handle 1310 (as shown in FIGS. 8 and 9), the coarse cutting zone 1140 will make contact with the skin surface 5000 first. The fine cutting zone 1240 will then make contact with the same surface 5000 after the coarse cutting zone 1140, allowing a closer trim or shave to be effected. In this way, the fine cutting zone 1240 will be pushed into contact with the skin surface 5000 by the biasing arrangement 1250. It is envisaged that this effect will allow for a finer trim while reducing the number of repetitions of trimming strokes over the same skin surface 5000.

However, a user may not always require such a close shave. In such an event, it is envisaged that the trimmer mechanism 1000 will further comprise a locking mechanism 1400. The locking mechanism 1400 is adapted and configured for locking the fine blade arrangement 1200 in its distanced position, so that it is less likely to make contact with the same surface 5000 of skin that the coarse cutting zone 1140 has just made contact with.

In one embodiment, it is envisaged that the locking mechanism 1400 could also lock relative movement between the blades 1210 of the fine blade arrangement 1200.

In another embodiment, the position of the fine blade arrangement 1200 is not locked. Instead the relative movement between its stationary blade 1220 and movable blade 1230 is locked to prevent these blades 1210 defining a fine cutting zone 1240 and trimming the user's hair as it passes over their skin surface 5000. In a most preferred embodiment, the locking mechanism 1400 will lock the fine blade arrangement 1200 in its distanced position as well as preventing or locking relative movement of the blades 1210.

In this way, having the fine blade arrangement 1200 movable between a close position and a distanced position also enables it to be locked by the locking mechanism 1400 if the fine blade arrangement 1200 is not required for use. This may be the case where only a coarse trim is required by the user.

It is envisaged that the trimmer mechanism 1000 will be powered by an electrical motor (not shown). The trimmer mechanism 1000 includes a mechanical linkage 1500 for driving movement of the fine blade arrangement 1200 and the coarse blade arrangement 1100 from the electrical motor.

The mechanical linkage 1500 includes a sliding arrangement 1510 and a rotating arrangement 1520 to translate rotational motion from an electrical motor into reciprocating linear movement to drive relative movement of the blades 1210, 1110 of the fine blade arrangement 1200 and the coarse blade arrangement 1100.

Figure 16:
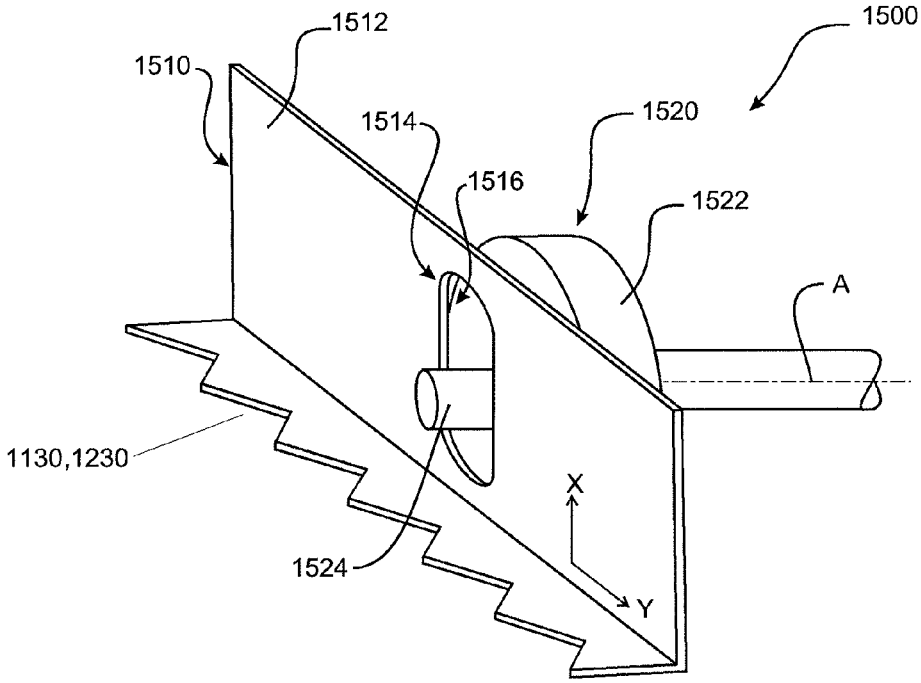
FIG. 16: shows a schematic perspective view of a mechanical linkage of a trimmer mechanism.

As shown in a schematic view in FIG. 16, the sliding arrangement 1510 comprises a sliding member 1512 movable in a linear sliding fashion and coupled to one or more movable blades 1130, 1230, and a receiving formation 1514 for receiving an off-centre rotating pin 1524. The receiving formation 1514 is an elongate recess or aperture, shown in the form of a slot 1516 that allows the pin 1524 to slide within the slot 1516 in one dimension X. But when the pin 1524 moves in another dimension Y, it drives linear reciprocating movement of the sliding member 1512.

The rotating arrangement comprises a rotating member 1522 rotatable about an axis A. The rotating member 1522 is rotatable by a rotating electrical motor. An off-centre pin 1524 extends from the rotating member. This pin 1524 is receivable into the slot 1516 of the sliding arrangement 1510.

It is envisaged that the trimmer mechanism 1000 may be incorporated as part of a hair trimmer 2000 as shown in FIG. 1, or as part of a hair trimmer attachment 3000 as shown in FIG. 5 that is removably coupled to a driver mechanism (not shown) that included an electrical motor.

In an embodiment where the trimmer mechanism 1000 is incorporated into a hair trimmer attachment 3000, it is envisaged that the sliding arrangement 1510 could be incorporated into the hair trimmer attachment 3000, while the rotating arrangement 1520 is incorporated into the driver. The hair trimmer attachment 3000 and driver will be removably coupled to each other by means of a coupling mechanism (not shown) for convenient coupling and decoupling.

In a preferred embodiment, the coupling mechanism is a bayonet type coupling mechanism, however it is envisaged that a variety of alternative couplings could be used. For example alternative couplings include a thread type coupling, a snap-fit type coupling, or any other coupling fit for purpose.

In an embodiment where the trimmer mechanism 1000 is incorporated into a hair trimmer 2000, it is envisaged that the hair trimmer (and also the driver for coupling to the hair trimmer attachment above) will include an electrical motor, as well as a power coupling (not shown) for coupling the electrical motor to a power source, such as the electrical mains or a battery housed within the housing 1300.

Referring now to FIGS. 10-15, in which similar features are generally indicated by similar numerals, a blade arrangement, and particularly a fine blade arrangement 1200 for a trimmer mechanism is now described. However, it will be appreciated that while the description makes reference to a fine blade arrangement 1200, the same aspects will be equally pertinent to similar features of a coarse blade arrangement 1100. The blade arrangement 1200 comprises a stationary blade 1220 and a movable blade 1230. Each of the substantially rectangular blades 1210 includes a pair of opposed major faces 1260, and a cutting edge 1214 defining a plurality of teeth 1212. In a preferred embodiment, the teeth of the blades are similar, however this need not be the case.

The blades 1210 are for mounting to a housing 1300. The stationary blade 1220 is secured to the housing in a stationary manner, while the movable blade 1230 is movably mounted to the housing 1300.

The blades 1210 are movable relative to each other in a linearly reciprocating movement. The blades 1210 abut each other at their major faces 1260.

One of the blades 1210, notably the stationary blade 1220 extends to a point further from the mounting than the movable blade in abutment with it. The stationary blade 1220 includes a lip 1270 along its cutting edge 1214 that extends out of the plane of the blade's major face. The lip 1270 extends distally of the cutting edge of the movable blade 1230.

It will be appreciated that in another embodiment, two movable blades 1210 can be used, with one of the movable blades including a lip 1270. However, there is increased expense and complexity involved in making two blades move instead of one, and having only one blade move will achieve the same effect (i.e. shearing hair).

Figure 12:
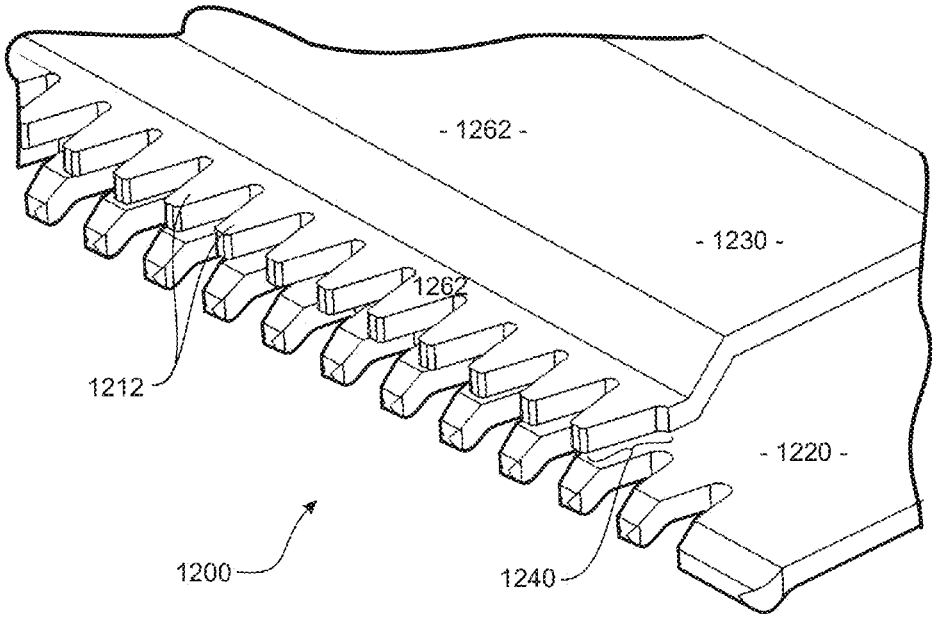
FIG. 12: shows a close up cutaway top perspective view of a first embodiment of a blade arrangement as shown in FIG. 10.

As shown in FIG. 12, the cutting edges of the blades 1210 are mounted in alignment so that the relative movement between the teeth 1212 on each of the adjacent cutting edges forms a cutting zone 1240.

Preferably, the lip 1270 extends out of the plane of the blade to form a substantially convex surface 1280 (shown in FIG. 14) for operational location against a surface to be trimmed (such as a user's skin). The convex surface 1280 is configured and dimensioned to prevent injury to a user when drawing the cutting zone 1240 across their skin, and can be comprised of a number of angled surfaces 1290.

In an alternative embedment, the lip 1270 extends out of the plane of the major face 1260 of the stationary blade 1220 to form an angled surface 1290 (shown in FIG. 14) for operational location against a surface to be trimmed, wherein the angled surface 1290 is configured and dimensioned to prevent injury to a user operationally.

In this respect it is envisaged that any edges will be rounded to assist in preventing cuts and nicks from sharp edges.

In one preferred embodiment (shown in FIGS. 13-15), the lip 1270 extends in the direction of, and at least partially around the teeth 1212 of the adjacent movable blade 1230.

Figure 10:
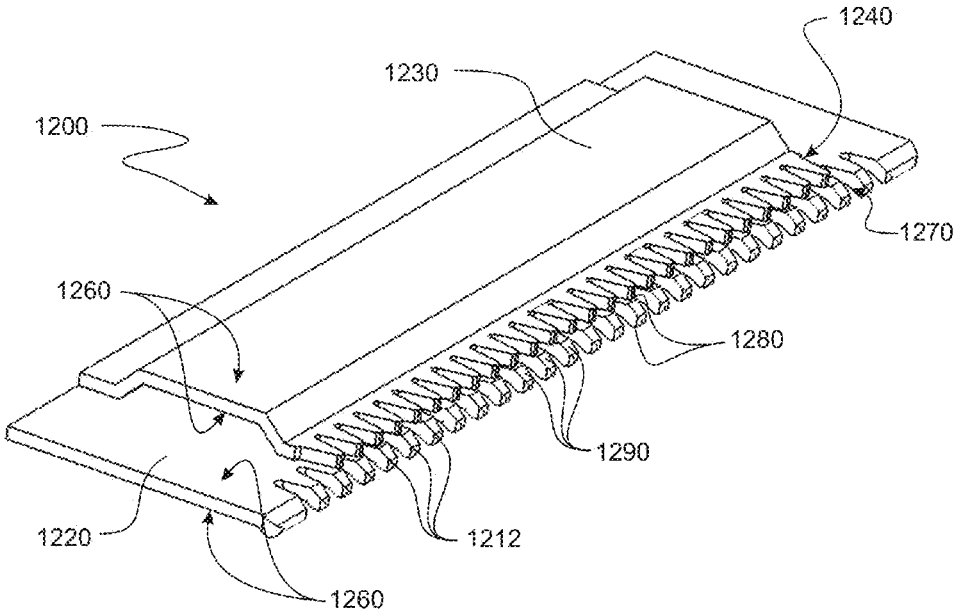
FIG. 10: shows a top perspective view of a first embodiment of a blade arrangement.
Figure 11:
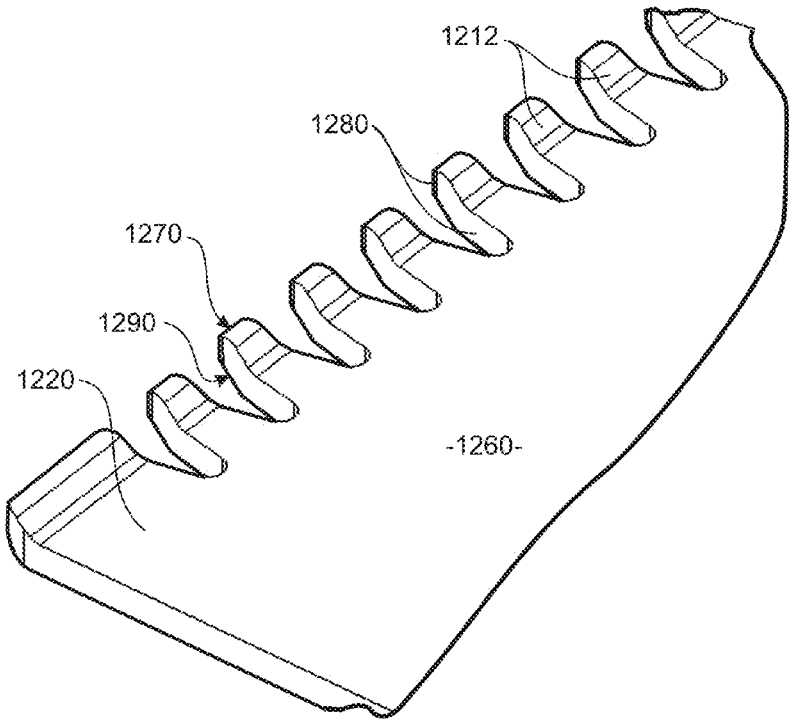
FIG. 11: shows a close up bottom perspective view of a first embodiment of a blade arrangement as shown in FIG. 10.

However, in another preferred embodiment shown in FIGS. 10-12, it is envisaged that the lip can extend in a direction away from the teeth 1212 of the adjacent movable blade 1230.

In both of the embodiments shown, the lip 1270 of the stationary blade 1220 only starts extending out of the plane of the major face 1260 at a point more distal than the most distal edge of the movable blade 1230.

In this way, the lip shields a user's skin from contact with the movable blade 1230, while enabling the thickness of the stationary blade 1220 and movable blade 1230 to be reduced. This allows for a closer trim by the blade arrangement, with a reduced risk of injury to a user. Means of reducing the thickness of a blade is discussed below.

In one embodiment (not shown) it is envisaged that the blades 1210 can have complementary engagement formations (not shown) adapted for movable engagement with each other. In this way, the relative movement between the blades 1210 can be guided by these complementary engagement formations. In one embodiment, such complementary engagement formations could be a channel formation (not shown) and a complementary ridge formation (not shown) that fits within the channel, or a track formation (not shown) and a track follower formation (not shown).

Figure 13:
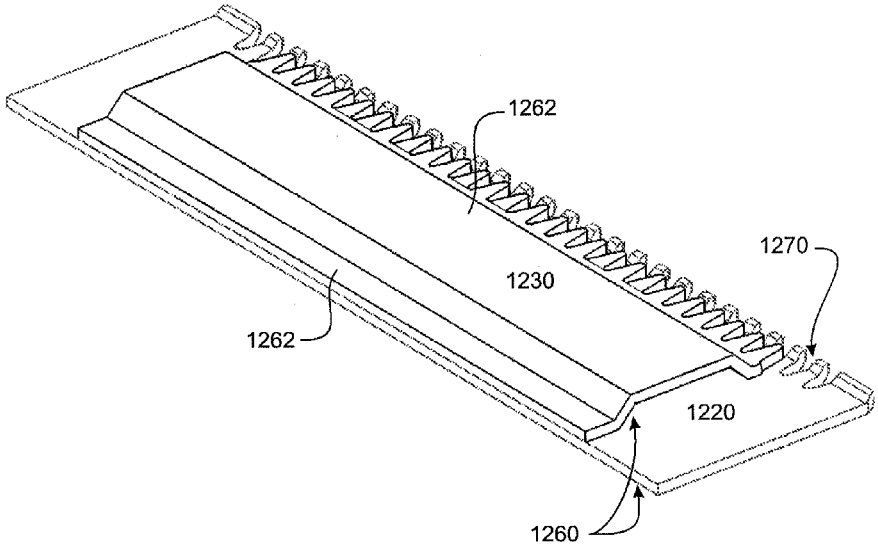
FIG. 13: shows a top perspective view of a second embodiment of a blade arrangement.
Figure 14:
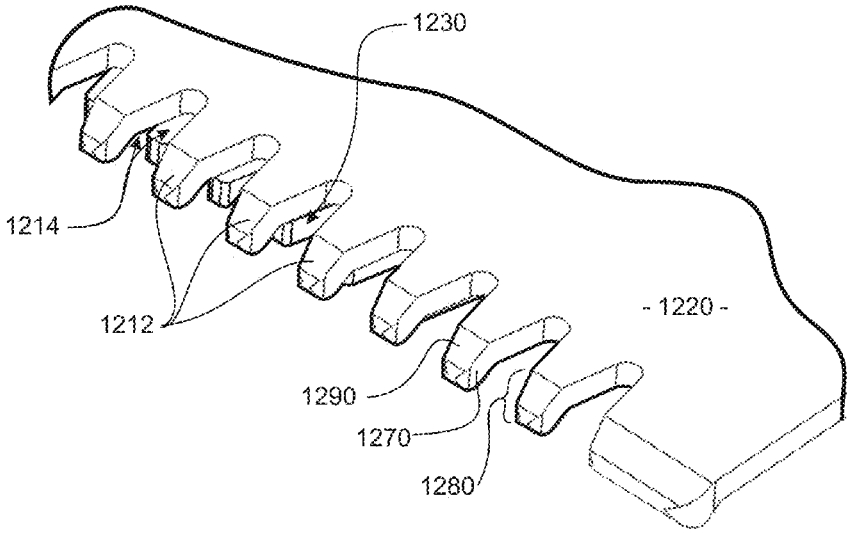
FIG. 14: shows a close up bottom perspective view of a second embodiment of a blade arrangement as shown in FIG. 13.
Figure 15:
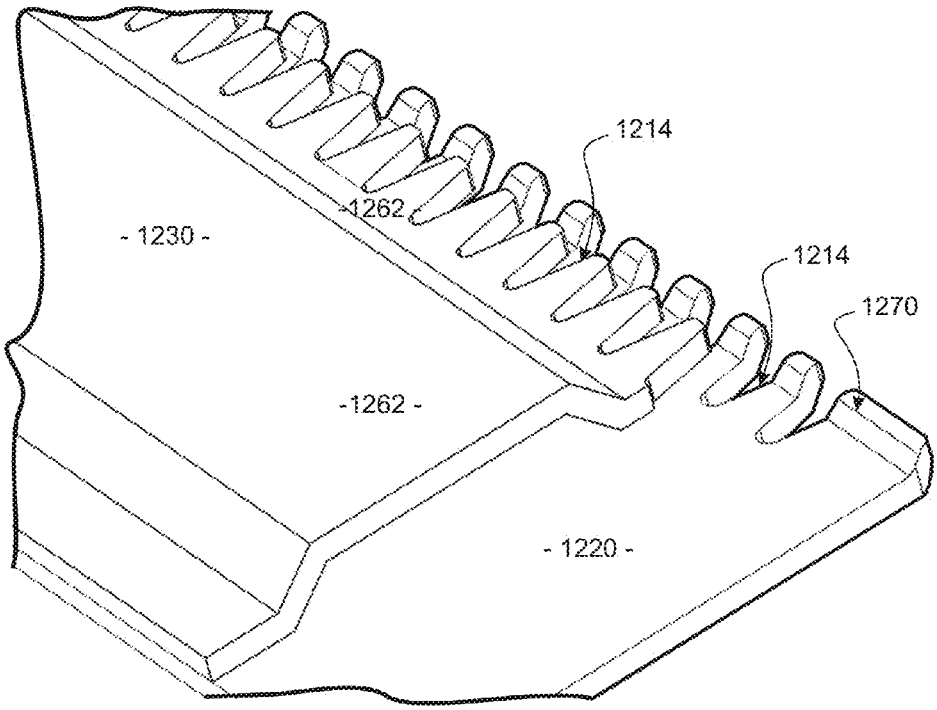
FIG. 15: shows a close up cutaway top perspective view of a second embodiment of a blade arrangement as shown in FIG. 13.

As shown in FIGS. 10 & 13, in one preferred embodiment the major face 1260 at the toothed cutting edge 1214 on the movable blade 1230 is out of plane with the rest of the major face 1260. This configuration is not to be confused with the lip 1270, as this formation is for reducing friction between the stationary blade 1220 and the movable blade 1230. It is envisaged that one or both of the stationary blade 1220 and the movable blade 1230 could have such a configuration.

In another embodiment (not shown), the major face at the toothed cutting edge 1214 is out of alignment with the rest of the major face 1260, but only on one of the major faces 1260 of the stationary blade 1220 or movable blade 1230.

It is envisaged that such a blade arrangement as described above will be included in a hair trimmer mechanism, hair trimmer or hair trimmer attachment as described above.

The blade arrangement 1200 described further requires manufacture by means of a novel and inventive manufacturing process, which will be described below.

The method of manufacturing the blade arrangement 1200 described above comprises the steps (not necessarily being in chronological order) of providing a planar plate of sheet material (not shown); deforming the plate to present a cutting edge defining a plurality of teeth along at least part of the cutting edge; and forming a lip on an edge of the cutting edge, wherein the lip extends out of the plane of the blade's major face.

The planar plate of sheet material initially provided has two opposed major faces. It is envisaged that the planar plate could be deformed so that portions of one or both major surfaces of the plate are out of plane with the other parts of that major surface. The steps for doing this will be described below.

The step of forming the lip 1270 may be carried out by supporting an opposed major surface of the plate except for the distal edge where the lip is to be bent, and applying a compressive force against the plate, to bend the lip over.

Alternately, it is envisaged that the area of the remainder of the plate, except for the area of the major face where the lip is, may be machined away.

In one preferred embodiment, the lip 1270 is formed so as to extend out of the plane of the plate to form a substantially convex surface 1280 for operational location against a user's skin. The shape of the convex surface has a radius without sharp edges to prevent injury to a user operationally.

The method envisages the additional step of rounding the edges of the lip 1270 are rounded to prevent cuts or nicks to a user by buffing or polishing the edges.

In an alternative preferred embodiment, the lip 1270 is formed to extend out of the plane of the plate to form one or more angled surfaces 1290 for operational location against a user's skin. These angled surface 1280 are rounded at their edges to prevent injury to a user operationally. It is envisaged that many small angled surfaces 1290 with rounded edges could achieve the same protective function as a radiused concave surface 1280.

In another embodiment of the invention, the method could include the step of grinding at least part of a major face of the plate to reduce the thickness of the plate. The step of grinding further can be carried out accurately to allow the major faces 1260 of the stationary blade 1220 and the movable blade 1230 that contact each other at an interface 1225 between the blades align closely with each other.

The step of grinding also assists in sharpening the cutting edge 1214 of the blades 1210, and typically those at the interface.

The method of manufacture also envisages the step of machining. Machining can be carried out in a known fashion, and is used to reduce the thickness of a plate to make the final blade thinner at the cutting edge 1214 to produce a finer trimming effect in use.

The methods described below include various combinations of the steps of deforming, machining and grinding.

It is envisaged that the step of deforming the plate could include one of three different types of sub-steps.

The step of deforming could include the sub-step of stamping it in a press and/or cutting mechanism while not providing support to the opposed major face, to cause the plate (i.e. both major faces) at the applied force to deform to a new level relative to that of the remainder of the plate, so that it is no longer coplanar with it, and is out of plane (i.e. give it a three dimensional form). This sub-step of deforming is referred to as "stamping" hereafter.

The step of deforming also could include the sub-step of cutting teeth shapes into the plate. This process relies on the application of a large force by a machine such as a hydraulic die press tool or the like, and will typically be carried out at the same time that the plate is given a three dimensional form as described above. However, the step of deforming could include the step of cutting the teeth shape without other forming of the major faces. This sub-step of deforming is referred to as "cutting" hereafter.

The step of deforming could also include a sub-step of applying a large force to part of a major face while supporting the opposed major face, to thereby cause the major face to which the large force is applied to, to flatten out, causing a change in levels of that major face (and a corresponding change in thickness of the plate). The opposed major face remains coplanar. This sub-step of deforming and will be referred to as "flattening" hereafter.

One preferred method comprises the first step of providing a preferably rectangular planar plate of metallic sheet material having two opposed major faces and two opposed edges. It is envisaged that such a plate could be provided in long lengths (not shown), which are later cut to specific lengths required for the blades.

The plate is then stamped to so that the cutting edge 1214 is at a different plane to that of the rest of the plate, forming three stamped surfaces 1262 are formed (as shown in FIGS. 10 and 13). It is envisaged that the step of cutting the shape of the teeth 1212 will occur simultaneously, but this need not necessarily be the case and could happen as a separate step.

After this step of deformation, the out of plane surfaces of the toothed cutting regions 1130, 1230 that are raised relative to the rest of the major faces can then be grinded down in a grinding process from the opposite side, so that the toothed cutting edge 1214 is thinner than the rest of the plate, to sharpen the teeth to the required sharpness, and to ensure that the cutting edge 1214 makes accurate abutting contact with the other blade in the blade arrangement.

In another alternative to this method, it is envisaged that after the step of stamping, there will be included a step of machining the cutting edge 1214 to make it thinner than the rest of the plate. This will allow teeth to be formed that will provide a finer trim.

Alternately, the step of machining can be carried out without the step of stamping to create different levels on the major surfaces of the plate—however, the teeth shape still needs to be cut into the plate in a cutting step.

After this machining step, a similar grinding process is followed as described above.

As an alternative to the step of machining, which may be an expensive and time consuming process, since it requires high accuracy machines and careful alignment, it is envisaged that the step of flattening (a subset of the step of deformation) can be used to flatten the cutting edge 1214 to reduce its thickness compared to the rest of the plate.

In one preferred method, the step of flattening would be carried out by a hydraulic press or by mechanical leverage to flatten out cutting edge 1214 while supporting the opposed major face. This flattening will only affect the level of one major face.

Once the flattening step has been carried out, the opposed major face 1260 can be grinded as described above.

It should be noted that the step of cutting the shape of the teeth into the plate during the deformation step will preferably be carried out after the step of flattening.

It is envisaged that cutting could be carried out before flattening, but this is not preferred, since the step of flattening may create inaccurate or inconsistent teeth 1212 shapes.

In this way, a stationary blade 1100 or movable blade 1200 may be manufactured to a high degree of accuracy, and with relatively low cost penalties.

It is envisaged that the step of forming a lip on an edge of the cutting edge 1214 will occur after stamping, machining and cutting has occurred, but before grinding (since the accuracy of the grinding may be affected by the forming of the lip). However, this need not be the case, and the lip could be formed at any stage.

Where in the foregoing description reference has been made to elements or integers having known equivalents, then such equivalents are included as if they were individually set forth.

Although the invention has been described by way of example and with reference to particular embodiments, it is to be understood that modifications and/or improvements may be made without departing from the scope or spirit of the invention.

In addition, where features or aspects of the invention are described in terms of Markush groups, those skilled in the art will recognise that the invention is also thereby described in terms of any individual member or subgroup of members of the Markush group.

What is claimed is:

1. A trimmer mechanism comprising a housing with an end and a coarse blade arrangement and a fine blade arrangement mounted on the end of the housing and facing the same direction, the coarse blade arrangement comprising a plurality of abutting longitudinal reciprocating blades, i. each of the blades of the coarse blade arrangement including a plurality of teeth disposed along a cutting edge, ii. the cutting edges of the coarse blades being at least partially in longitudinal alignment with each other so that relative movement between the teeth define a coarse cutting zone suitable for trimming hair, and b. said fine blade arrangement comprising a plurality of abutting longitudinal reciprocating blades, i. each of the blades of the fine blade arrangement including a plurality of teeth disposed along a cutting edge, ii. the cutting edges of the fine blades being at least partially in longitudinal alignment with each other so that relative movement between the teeth define a fine cutting zone suitable for trimming hair, iii. wherein the fine blade arrangement is configured and adapted to to define a fine cutting zone which is above the coarse cutting zone defined by the coarse blade arrangement.

2. A trimmer mechanism as claimed in claim 1, wherein a characteristic of the teeth of at least one of the blades in the fine blade arrangement is smaller than a corresponding characteristic of the teeth of one of the blades of the coarse blade arrangement, said one blade of the fine blade arrangement including teeth with the smallest characteristic of any of the blades in the coarse blade arrangement, said characteristic being at least one of:

a) length of the teeth, b) width of the teeth, c) size of the teeth, d) thickness of the teeth, and e) pitch of the teeth.

3. A trimmer mechanism as claimed in claim 1, wherein one or more characteristic of the teeth of the fine blades, said characteristic selected from length, width, size, thickness and pitch of the teeth is smaller than a corresponding characteristic of the coarse blades.

4. A trimmer mechanism as claimed in claim 1, wherein the plurality of blades of the fine blade arrangement comprises at least one stationary blade and at least one movable blade.

5. A trimmer mechanism as claimed in claim 4, wherein the stationary blade of said fine blades extends further from the housing than the movable blade of the fine blade arrangement, and wherein the teeth of said stationary blade include a lip formation along at least part of a distal edge that extends out of the plane of the blade.

6. A trimmer mechanism as claimed in claim 5, wherein the lip extends out of a plane defined by the fine stationary blade to form a convex surface for operational location against a surface to be trimmed.

7. A trimmer mechanism as claimed in claim 5, wherein the lip of the fine stationary blade extends away from the teeth of the fine movable blade.

8. A trimmer mechanism as claimed in claim 1, wherein the plurality of blades of the coarse blade arrangement comprises at least one stationary blade and at least one movable blade.

9. A trimmer mechanism as claimed in claim 1, wherein the blades of at least one of the coarse blade arrangement and the fine blade arrangement each comprise a pair of opposed major faces.

10. A trimmer mechanism as claimed in claim 1, wherein the plurality of blades of at least one of the coarse blade arrangement and the fine blade arrangement abut each other at a major face.

11. A trimmer mechanism as claimed in claim 1, wherein the fine cutting zone is disposed in parallel alignment with the coarse cutting zone.

12. A trimmer mechanism as claimed in claim 1, wherein the fine blade arrangement is disposable in an alignment relative to the coarse blade arrangement, so that operationally when the coarse cutting zone is drawn over a surface, the fine cutting zone makes contact with the same surface.

13. A trimmer mechanism as claimed in claim 1, wherein the fine blade arrangement is mounted on said housing so as to be movable between a. a close position in which the fine cutting zone is disposed in an alignment relative to the coarse blade arrangement so that operationally when the coarse cutting zone is drawn over a surface, the fine cutting zone makes contact with the same surface; and b. a distanced position in which the fine cutting zone is positioned further from the coarse cutting zone than when the fine blade arrangement is in the close position.

14. A trimmer mechanism as claimed in claim 13, wherein the fine blade arrangement includes a second movable housing, mounted on the housing, said second movable housing movable between the close position and the distanced position of the fine blade arrangement.

15. A trimmer mechanism as claimed in claim 13, wherein the fine blade arrangement is biased towards the close position by a biasing arrangement.

16. A trimmer mechanism as claimed in claim 15, wherein the biasing arrangement includes one or more selected from a a. spring; and b. resilient member.

17. A trimmer mechanism as claimed in claim 13, wherein the fine cutting zone remains in parallel alignment with the coarse cutting zone while the fine blade arrangement is movable between the closed position and distance position.

18. A trimmer mechanism as claimed in claim 1, wherein the fine cutting zone is substantially planar in configuration.

19. A trimmer mechanism as claimed in claim 1, wherein the coarse cutting zone is substantially planar in configuration.

20. A trimmer mechanism as claimed in claim 19, wherein the fine blade arrangement is mounted on said housing so as to be movable between a. a close position in which the fine cutting zone is disposed in an alignment relative to the coarse blade arrangement so that operationally when the coarse cutting zone is drawn over a surface, the fine cutting zone makes contact with the same surface; and b. a distance position in which the fine cutting zone is positioned further from the coarse cutting zone than when the fine blade arrangement is in the close position, and the fine cutting zone remains in parallel planar alignment with the coarse cutting zone while the fine blade arrangement is movable between the close position the distance position.

21. A trimmer mechanism as claimed in claim 1, wherein the fine blade arrangement is mounted on said housing so as to be movable between:

a. a close position in which the fine cutting zone is disposed in an alignment relative to the coarse blade arrangement so that operationally when the coarse cutting zone is drawn over a surface, the fine cutting zone makes contact with the same surface; and b. a distance position in which the fine cutting zone is positioned further from the coarse cutting zone than when the fine blade arrangement is in the close position, and wherein the fine cutting zone moves closer to longitudinal alignment with the coarse cutting zone as the fine blade arrangement moves from the distanced position to the close position.

22. A trimmer mechanism as claimed in claim 1, wherein the fine blade arrangement is mounted on said housing so as to be movable between a. a close position in which the fine cutting zone is disposed in an alignment relative to the coarse blade arrangement so that operationally when the coarse cutting zone is drawn over a surface, the fine cutting zone makes contact with the same surface; and b. a distance position in which the fine cutting zone is positioned further from the coarse cutting zone than when the fine blade arrangement is in the close position, and wherein the trimmer mechanism further comprises a locking mechanism adapted and configured for locking the fine blade arrangement in the distanced position.

23. A trimmer mechanism as claimed in claim 22, wherein the locking mechanism is located adjacent said fine blade arrangement and is configured and adapted to engage with the blades of the fine blade arrangement to prevent relative movement of the blades simultaneously with engagement of the locking mechanism so as to lock the fine blade arrangement in the distanced position.

24. A trimmer mechanism as claimed in claim 23, wherein the locking mechanism is located adjacent said fine blade arrangement and is configured and adapted to engage with the blades of the fine blade arrangement to lock relative movement of the blades simultaneously with engagement of the locking mechanism so as to lock the fine blade arrangement in the distanced position.

25. A trimmer mechanism as claimed in claim 1, wherein the trimmer mechanism further comprises a movement locking mechanism located adjacent said fine blade arrangement and adapted and configured to engage with the blade of the fine blade arrangement so as to lock relative movement of the blades of the fine blade arrangement.

26. A trimmer mechanism as claimed in claim 25, wherein the movement locking mechanism, when engaged so as to lock relative movement of the blades of the fine blade arrangement, allows movement of the fine blade arrangement between the distanced position and the close position.

27. A trimmer mechanism as claimed in claim 1, wherein the trimmer mechanism further comprises a mechanical linkage for driving the reciprocating movement of the fine blades and the coarse blades.

28. A trimmer mechanism as claimed in claim 27, wherein the mechanical linkage translates rotational motion from an electrical motor into reciprocating linear movement to drive the reciprocating movement of the blades of the fine blade arrangement and the coarse blade arrangement.

29. A trimmer mechanism as claimed in claim 27, wherein the mechanical linkage further includes a rotating arrangement comprising a. a rotating member rotatable about an axis, and b. a pin extending from the reciprocating member off center from the axis.

30. A trimmer mechanism as claimed in claim 27, wherein the mechanical linkage includes a sliding arrangement comprising a. a sliding member movable in a linear sliding fashion and coupled, directly or by way of a coupling, to one or more of the movable blades;

b. a receiving formation for receiving an off-centre rotating pin, said receiving formation being adapted to allow the pin to slide within the receiving formation in one dimension, and to drive the linear sliding movement of the sliding member when the pin moves in a second dimension.

31. A trimmer mechanism as claimed in claim 30, wherein the receiving formation is one or more selected from an elongate recess or aperture.

32. A trimmer mechanism as claimed in claim 1, wherein the housing includes a handle portion for convenient manual manipulation of the trimmer mechanism.

33. A hair trimmer including a trimmer mechanism as claimed in claim 1.

34. A hair trimmer attachment including a trimmer as claimed in claim 1.

* * * * *